United States Patent [19]

Wegner

[11] 4,034,926

[45] July 12, 1977

[54] GAUZE DISPENSER

[76] Inventor: Rudolph Wegner, 7325 Craig Ave. E., Inner Grove Heights, Minn. 55075

[21] Appl. No.: 655,279

[22] Filed: Feb. 4, 1976

[51] Int. Cl.[2] ..... B65D 13/00; B65D 85/672

[52] U.S. Cl. ..... 242/55.53; 206/406; 206/408; 206/409; 206/805; 220/4 E; 220/335

[58] Field of Search ..... 242/55.53; 206/398, 206/399, 402–409, 805, 440; 220/4 B, 4 E, 334, 335

[56] References Cited

U.S. PATENT DOCUMENTS

| | | | |
|---|---|---|---|
| 1,003,995 | 9/1911 | Denoon, Jr. | 242/55.53 |
| 1,168,703 | 1/1916 | Bauer | 242/55.53 |
| 1,212,020 | 1/1917 | Contant, Jr. | 242/55.53 |
| 1,525,745 | 2/1925 | Keefer | 206/805 X |
| 1,540,876 | 6/1925 | Dwyer | 242/55.53 |
| 2,088,171 | 7/1937 | Kaufman | 206/805 X |
| 2,737,353 | 3/1956 | Banks, Jr. | 242/55.53 |
| 2,752,106 | 6/1956 | Thompson | 242/55.53 |
| 2,798,597 | 7/1957 | Thompson | 242/55.53 |
| 3,405,983 | 10/1968 | Rutz | 242/55.53 X |

FOREIGN PATENT DOCUMENTS

| | | | |
|---|---|---|---|
| 801,016 | 12/1950 | Germany | 206/403 |
| 100,433 | 6/1962 | Norway | 206/406 |

*Primary Examiner*—Stephen Marcus
*Attorney, Agent, or Firm*—Schroeder, Siegfried, Ryan & Vidas

[57] ABSTRACT

A container and dispenser for a rolled sheet of gauze material which permits a user to dispense a selected length of gauze without touching the surface of the gauze during the dispensing operation, and which prevents the dispensing of additional gauze at other times.

2 Claims, 2 Drawing Figures

GAUZE DISPENSER

This invention relates to apparatus for storing ad dispensing rolled sheet material and more particularly to apparatus for dispensing rolled gauzed material.

The present invention and apparatus is used for storing a roll of gauze and permits selected lengths of the gauze to be readily dispensed.

Medical and first aid personnel, particularly when working away from a mdical facility, have often found a need for a more convenient way to dispense gauze than from the package in which the gauze is received from the manufacturer. The present invention provides a container for storing gauze which permits the gauze to be readily dispensed in desired lengths by medical and first aid personnel.

Accordingly, it is an object of this invention to provide an improved gauze dispenser.

It is a further object of this invention to provide a gauze dispenser which prevents inadvertent unrolling of gauze material.

These and other objects and advantages of the invention more fully appear from the following description made in connection with the accompanying drawings, wherein like reference characters refer to the same or similar parts throughout the several views and in which.

The drawings show various views of the preferred embodiment of the gauze dispenser utilizing the teachings of the present invention.

Figure 1:
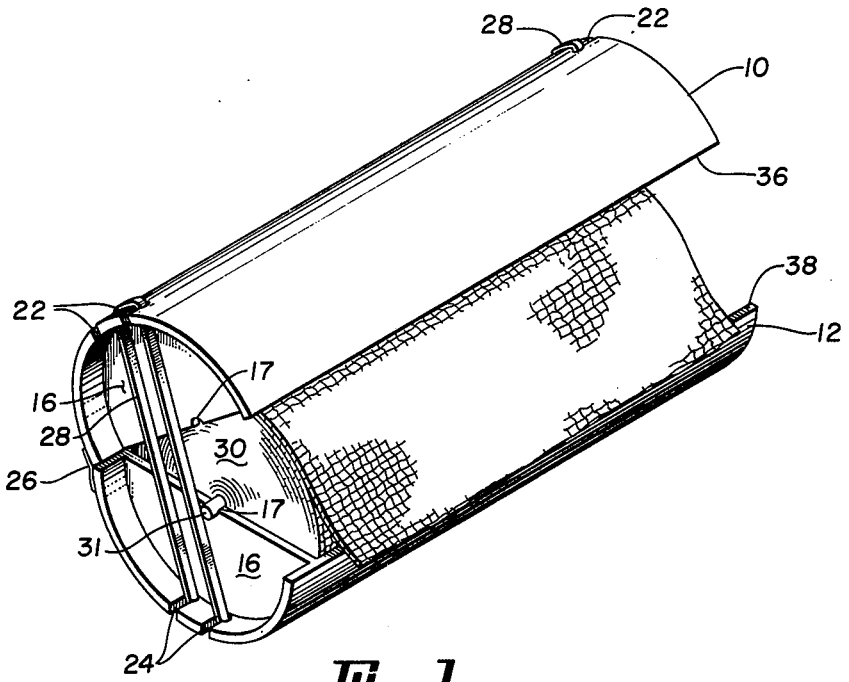
FIG. 1 is an elevation drawing showing the dispenser in a partially opened configuration.
Figure 2:
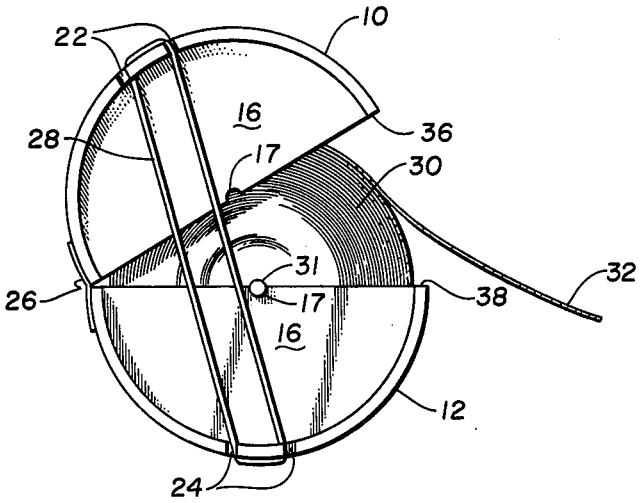
FIG. 2 is an end view of the gauze dispenser in the partially opened condition.

In FIGS. 1 and 2, the preferred embodiment of the gauze dispenser is shown. The dispenser comprises an upper portion 10 and a lower portion 12 which comprise halves of a cylinder. Both ends of upper and lower sections 12 are closed with end sections 16 into which a notch 17 has been formed to accept an axle. The half cylindrical surfaces of portions 10 and 12 project beyound end walls 16 and are slotted with slots 22 and 24 respectively to form a projection to which an elastic band may be attached.

Upper and lower portions 10 and 12 are joined together along one axially extending side by a low friction hinge such as tape 26. A conventional rubber elastic band 28 encircles the projections between slots 22 and 24 to exert a closing force on the two hinged sections 10 and 12 of the container.

The container is loaded for use by opening upper and lower portions 10 and 12 and inserting a rolled sheet of gauze 30 wound on an axle 31. An unrolled end 32 of the gauze projects from the dispenser between upper and lower portions in the dispenser with end 32 projecting therefrom, the dispenser is closed and held in the closed position by action of elastic band 28. The gauze gripping force applied by edges 36 and 38 of the upper portion 10 and lower portion 12 respectively, prevents undesired unraveling of the roll of gauze and permits the user to grasp the end of the sheet 32 to withdraw a desired amount of gauze. The tension exerted by the elastic band 28 permits the gauze material to be rapidly withdrawn as long as a positive pressure is applied. If desired, the amount of tension can be adjusted merely by relooping the rubber band over the projection between slots 22 and 24 to shorten the effective length of the rubber band and increase the amount of tension and closting force it exerts.

The gauze dispenser permits the gauze to be dispensed by a worker performing first aid at a remote location without being contacted by the worker's hands and permits the gauze to be protected from the elements until the gauze is unrolled. After a selected amount of gauze has been unrolled, the positive tension exerted by elastic band 28 on surfaces 36 and 38 which hold the projecting portion of the gauze, permits the user to allow the dispenser to hang in place without further unrolling until the gauze is cut. Thus, the worker can dispense the desired quantity of gauze while wrapping a wound, for example, and then release his grip on the dispenser, without further gauze being inadvertently dispensed until it is desired to cut the gauze.

It will be apparent to those skilled in the art that various changes may be made and the details of construction of the apparatus herein without departing from the inventive concept. The scope of the invention is, therefore, not limited to that which is shown in the drawings and described in the specification, but only as indicated in the appended claims.

I claim:

1. A dispenser for rolled gauze comprising:

a. a two-pieced hinged container formed from a cylindrical tube with closed ends, said tube being cut along its axis into an upper and lower portion which are hinged along one axially extending side which, in an opened condition, is adapted to receive a roll of gauze and, in a closed condition, encloses said roll of gauze, and inpinges upon the upper and lower surfaces of an unrolled end of said roll of gauze which passes through the junction between the two pieces of the container, a portion of said tube extending beyond its closed end and including at least a pair of slots in the portion of said tube extending beyond the closed end in each of the upper and lower portions of said tube, each pair of slots defining a projection therebetween and, b. at least one rubber elastic band having one end inserted into said slots and over said projection from said upper portion and the other end inserted into said slots over the projection from said lower portion of said container to exert a closing force urging the container into a closed condition and applying force to the upper and lower surfaces of the unrolled end of the roll of gauze thereby inhibiting unintended movement.

2. A dispenser according to claim 1 wherein said upper and lower portion comprise equal halves of said cylindrical tube and said projections from said upper and said lower portions are located at approximately the midpoint of said cylindrical portions.

* * * * *